US011638460B2

(12) United States Patent
Winefordner et al.

(10) Patent No.: US 11,638,460 B2
(45) Date of Patent: May 2, 2023

(54) MOUNTAIN BIKE SHOE SOLE WITH IMPROVED ACCESS FOR THE PEDAL

(71) Applicant: Crank Brothers, Inc., Laguna Beach, CA (US)

(72) Inventors: Carl Winefordner, Laguna Beach, CA (US); Frank Hermansen, Laguna Beach, CA (US)

(73) Assignee: CRANK BROTHERS, INC., Laguna Beach, CA (US)

( * ) Notice: Subject to any disclaimer, the term of this patent is extended or adjusted under 35 U.S.C. 154(b) by 239 days.

(21) Appl. No.: 16/989,250

(22) Filed: Aug. 10, 2020

(65) Prior Publication Data

US 2022/0039510 A1 Feb. 10, 2022

(51) Int. Cl.
*A43B 5/14* (2006.01)
*A43B 13/14* (2006.01)

(52) U.S. Cl.
CPC ..... *A43B 5/14* (2013.01); *A43B 13/14* (2013.01)

(58) Field of Classification Search
CPC ..... A43B 13/146; A43B 13/145; A43B 13/14; A43B 5/04
See application file for complete search history.

(56) References Cited

U.S. PATENT DOCUMENTS 3,964,343 A * 6/1976 Lauterbach ..... B62M 3/086 482/57
4,188,737 A * 2/1980 Haver ..... A43B 1/0036 36/137
4,640,151 A * 2/1987 Howell ..... B62M 3/086 36/131
4,803,894 A * 2/1989 Howell ..... A43B 5/14 36/131
4,815,333 A * 3/1989 Sampson ..... B62M 3/086 36/131
4,898,063 A * 2/1990 Sampson ..... B62M 3/086 36/131
5,125,173 A * 6/1992 Nagano ..... B62M 3/086 36/131
5,377,561 A * 1/1995 Danieli ..... B62M 3/086 36/131
5,473,963 A * 12/1995 Aeschbach ..... A43B 5/14 36/131
5,685,093 A * 11/1997 Lin ..... A43B 1/0054 36/131
6,006,451 A * 12/1999 Morris ..... A43B 23/227 36/72 A
6,115,946 A * 9/2000 Morris ..... A43B 13/24 36/72 A
6,189,242 B1 * 2/2001 Lin ..... A43B 5/14 36/131
6,260,291 B1 * 7/2001 Farys ..... A43B 5/14 36/108

(Continued)

OTHER PUBLICATIONS

Stomp: Traction in our way, shape and form. https://rideissi.com/articles/stomp-traction-in-our-way-shape-and-form (Year: 2018).*

*Primary Examiner* — Bao-Thieu L Nguyen
(74) *Attorney, Agent, or Firm* — Tutunjian & Bitetto, P.C.

(57) ABSTRACT

A mountain bike shoe sole, including an outsole having a lower surface and a tread, and at least a recessed area including an inner surface and at least one ramp.

20 Claims, 13 Drawing Sheets

(56) References Cited

U.S. PATENT DOCUMENTS 6,299,192 B1 * 10/2001 Bryce ..... B63B 32/47 280/14.22
6,331,007 B1 * 12/2001 Bryce ..... A63C 17/01 280/634
6,494,117 B1 * 12/2002 Bryne ..... B62M 3/086 36/132
7,017,445 B2 * 3/2006 Bryne ..... A43B 5/14 74/594.6
7,540,101 B2 * 6/2009 Harrington ..... B62M 3/086 36/131
9,596,906 B2 * 3/2017 Lee ..... A43B 13/145
9,795,184 B2 * 10/2017 Ueda ..... A43B 5/14
10,342,285 B2 * 7/2019 Aoki ..... A43B 13/14
10,595,586 B2 * 3/2020 Winefordner ..... A43B 13/223
11,311,073 B2 * 4/2022 Chen ..... A43B 13/026
2004/0187635 A1 * 9/2004 Bryne ..... B62M 3/086 74/594.4
2006/0016102 A1 * 1/2006 Xie ..... A43B 5/14 36/131
2011/0138658 A1 * 6/2011 Ueda ..... A43B 5/14 36/131
2012/0000095 A1 * 1/2012 Torrance ..... A43B 13/16 36/114
2013/0298428 A1 * 11/2013 Tews ..... A43C 15/16 36/134
2014/0259796 A1 * 9/2014 Hillyer ..... A43B 5/14 36/134
2016/0157556 A1 * 6/2016 Barnes ..... A43B 5/14 36/31
2016/0249704 A1 * 9/2016 Aoki ..... A43B 13/14 36/131
2016/0309840 A1 * 10/2016 Lee ..... A43B 5/14
2018/0146741 A1 * 5/2018 Martin ..... A43B 5/14
2018/0257738 A1 * 9/2018 Terblanche ..... A43B 5/14
2019/0142106 A1 * 5/2019 Winefordner ..... A43B 3/0078 36/103
2020/0016459 A1 * 1/2020 Smith ..... B62J 45/41

* cited by examiner

MOUNTAIN BIKE SHOE SOLE WITH IMPROVED ACCESS FOR THE PEDAL

FIELD OF THE INVENTION

The present invention relates to a mountain bike shoe sole with an improved access.

More in particular, the invention relates to a mountain bike shoe sole to be used with clip-in or clipless bicycle pedals, which facilitates the engagement of the pedal during use.

BACKGROUND

During bike rides, especially with mountain bikes or during down-hill rides, the user has the need to engage and disengage several times the shoes and the pedals. The use of clip-in or clipless pedals has developed some years ago, and is now widely spread.

With clipless pedals, the bicycle shoes, especially mountain bike shoes, usually have a sole with a recessed area for housing and fitting a two-hole pedal cleat (usually called an SPD compatible cleat), by means of a threaded fastener placed in the sole. Such fastener can usually slide fore and aft and slightly rotate in order to adjust and customize the connection position of the SPD compatible cleat, which can in turn engage the engagement mechanism of a pedal.

For releasing the pedal from the shoe, the user has to rotate the sole in order to disengage the engagement mechanism of the pedal and the sole cleat.

However, it is not always easy to engage the pedal on the shoe and therefore there is the need of a shoe equipped with a sole able to provide an easy access to the cleat for the pedal.

OBJECTS OF THE INVENTION

The technical aim of the present invention is therefore to improve the state of the art in the field of mountain bike shoe soles.

Within such technical aim, it is an object of the invention to develop a mountain bike shoe sole which allows to obviate the drawbacks previously complained.

Another object of the present invention is to develop a mountain bike shoe sole with an easy access for pedal engagement.

Still another object of the present invention is to develop a mountain bike shoe sole which allows the rider to pedal safely and effectively even without the cleat of the outsole being engaged in the engagement mechanism of the pedal.

A further object of the present invention is to devise a mountain bike shoe sole which allows achieving the foregoing objects with a technical solution which is constructively simple and inexpensive.

SUMMARY OF THE INVENTION

This aim and these objects are all achieved by a mountain bike shoe sole according to the present application.

The mountain bike shoe sole comprises an outsole, having a lower surface and a tread, at least a recessed area, provided in the lower surface, for housing a cleat assembly, and at least one ramp near the recessed area, and in particular a first ramp or entry ramp, for an easy access of the engagement mechanism of the clipless pedal in the recessed area.

According to a further aspect of the invention, the mountain bike shoe sole includes at least two ramps near the recessed area, and in particular a first ramp or entry ramp and a second ramp or exit ramp, the latter allowing an easy exit of the engagement mechanism of the clipless pedal, when the engagement with the cleat is not needed/successful.

According to still another aspect of the invention, the mountain bike shoe sole includes a securement block and/or a hollow seat, which acts as a temporary block area when the engagement of the shoe and the pedal is not successful.

According to another aspect of the invention, the recessed area has a sidewall with a defined height; such height is the same along all the development of the sidewall and this improve the engagement/disengagement steps for the shoe and the pedal.

According to still another aspect of the invention, the tread of the outsole includes area specific pattern based on curved lines and/or grooves. Such pattern has the aim to improve the rotation of the shoe during the engagement step with the pedal and the disengagement step from the same, as the curved lines and/or grooves follow the rotation direction. In this way, friction is reduced, for an easy function of the shoe sole.

According to still another aspect of the invention, the embodiment in which there is a second ramp or exit ramp can be provided also with at least one stopper, the at least one stopper is placed at the end of the second ramp or exit ramp, opposite to the recessed area. They act as a "real" obstacle, which is able to stop the sliding of the pedal to the sole, when the engagement with the show is not successful. In this way the user feels safer and further risks linked to the failed engagement are avoided.

According to still another aspect of the invention, the lower surface of the sole, at the recessed area and/or in the front part thereof, has a curvature radius of a determined size. The size is linked to the amplitude of the foot movement, during engagement and disengagement, thus making an easy access for the pedal and for its engagement with the shoe. The movement freedom for the food is ensured.

BRIEF DESCRIPTION OF THE DRAWINGS

These and other advantages will be better understood by any man skilled in the art from the following description that follows and from the attached drawings, given as a non-limiting example, in which.

DETAILED DESCRIPTION OF THE INVENTION

In the specification, the word "fore" or "front" indicates an object or part positioned in the front position of the sole and/or of the shoe, i.e. in the portion of the sole and/or the shoe at the toe area.

The word "rear" or "aft" indicates an object or part positioned in the rear position of the sole and/or of the shoe, i.e. in the portion of the sole and/or the shoe at the heel area.

The word "lateral" or "side" indicates an object or part positioned in the side position of the sole and/or of the shoe, i.e. in the portion of the sole and/or the shoe at the foot side area. Such foot side area can be better defined, if needed, as "inner" or "medial" side rather than "outer" side, if it is meant a position in the inner or outer side of the foot.

The direction "longitudinal" indicates a direction going from the toe to the heel of the foot and/or of the sole and/or of the shoe; the word "cross" indicates a direction going from side to side of the foot and/or of the sole and/or of the shoe.

The word "height", if nor otherwise indicated, means a size in a direction substantially perpendicular to the ground, or in any case moving rising up from the ground, while the word "width" indicates a size considering the direction from side to side of the shoe and/or sole and the word "length" indicates a size considering the direction from toe to heel of the shoe and/or sole.

Figure 1:
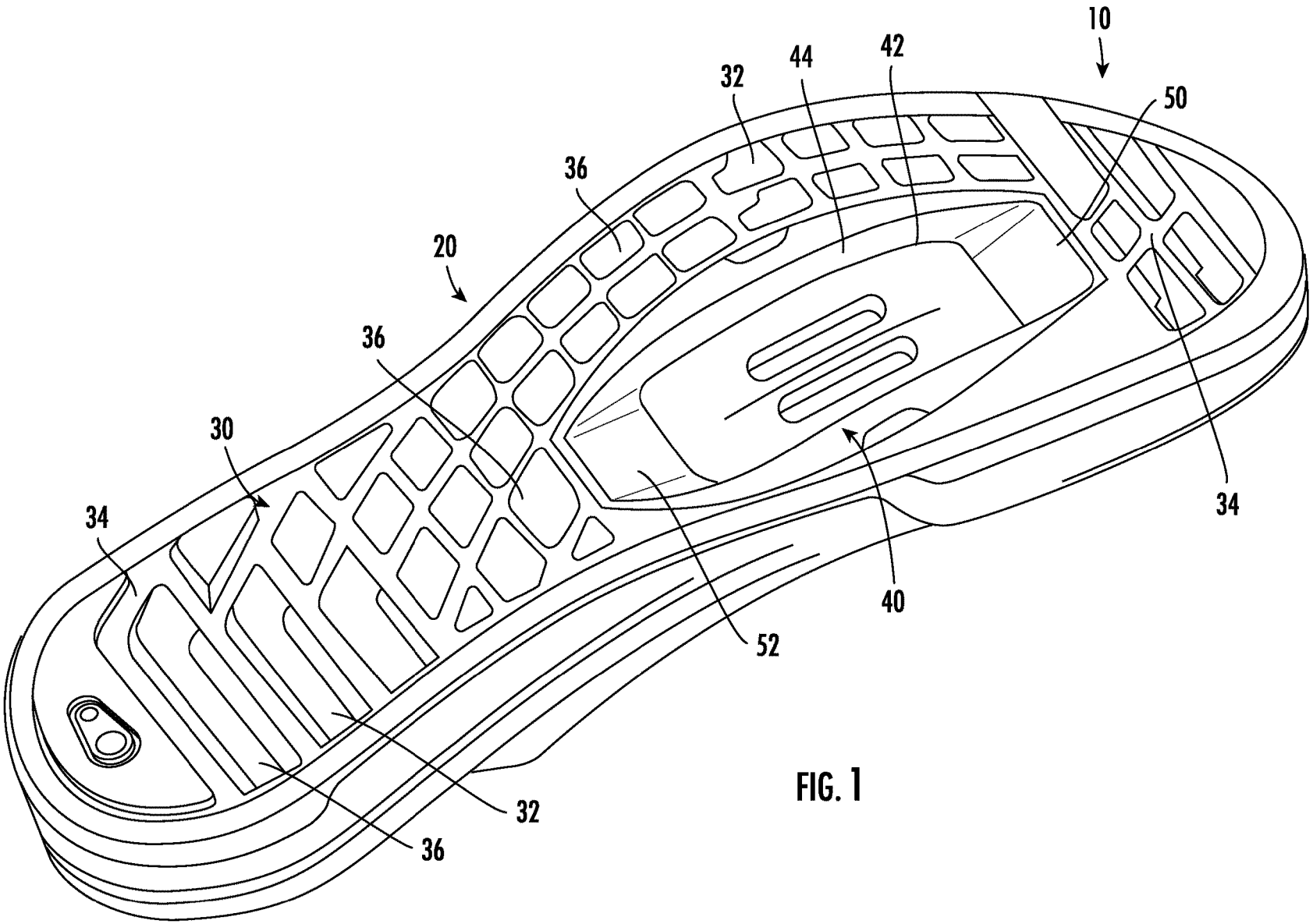
FIG. 1 is a perspective view of the mountain bike shoe sole according to an embodiment of the invention.

With reference to FIG. 1, the reference number 10 indicates a mountain bike shoe sole according to the invention.

The sole 10 includes, more in detail, an outsole 20, which defines a lower surface suitable to contact the ground or a bicycle pedal, specifically a clip-in or clipless pedal of a bicycle or mountain bike.

The sole 10 and/or the outsole 20 has or defines a tread 30.

The tread 30 has a pattern which help the user to walk or run or in any case to grip on the ground.

The tread 30 in made in a rubber material, in order to better adapt to the different soils on which the sole has to be placed, and to confer a proper grip also on the pedal and also on slippery surfaces.

The rubber material is, in a version of the invention, at least one of the following compounds: butadiene rubber (RB), isobutylene-isoprene rubber or butyl rubber (IIR), bromine butyl rubber (BIIR), BIIR and RB, natural rubber (NR), etc., mixture thereof.

In another version of the invention, the outsole 20 and/or the tread 30 and/or the sole 10 can be made in a rubber material of the kinds indicated above, or thermoplastic polyurethane (TPU), ethyl vinyl acetate (EVA), PHYLON, polyurethane (PU), polyvinyl chloride (PVC), PEBAX, NYLON, carbon fiber, glass fiber, composites materials, and so on.

The main body of the sole 10 (or its midsole) can be made, in one version of the invention, of EVA (ethyl vinyl acetate).

In particular, the tread 30 of the sole 10 comprises a plurality of studs 32.

Each stud 32 can have—in a plan view—a square, rectangular, polygonal or irregular shape.

Each stud 32 is delimited by at least one channel 34, which forms a recessed "line" or zone in the outsole 20.

Therefore, each stud 32 has a sidewall raised inwardly with respect to the lower surface of the sole and a base face 36 which defines the lower surface of the sole 10.

Also the base face 36 can have—in a plan view—a square, rectangular, polygonal or irregular shape.

Figure 2:
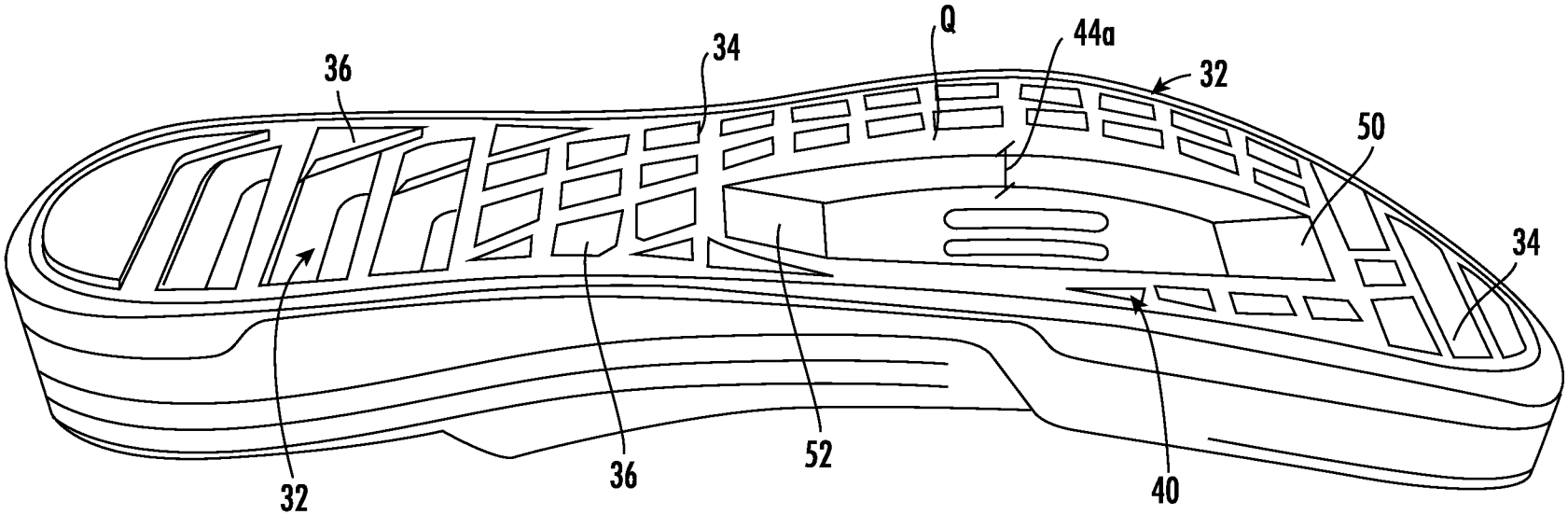
FIG. 2 is a perspective view from the inner side of the mountain bike shoe sole of FIG. 1.
Figure 3:
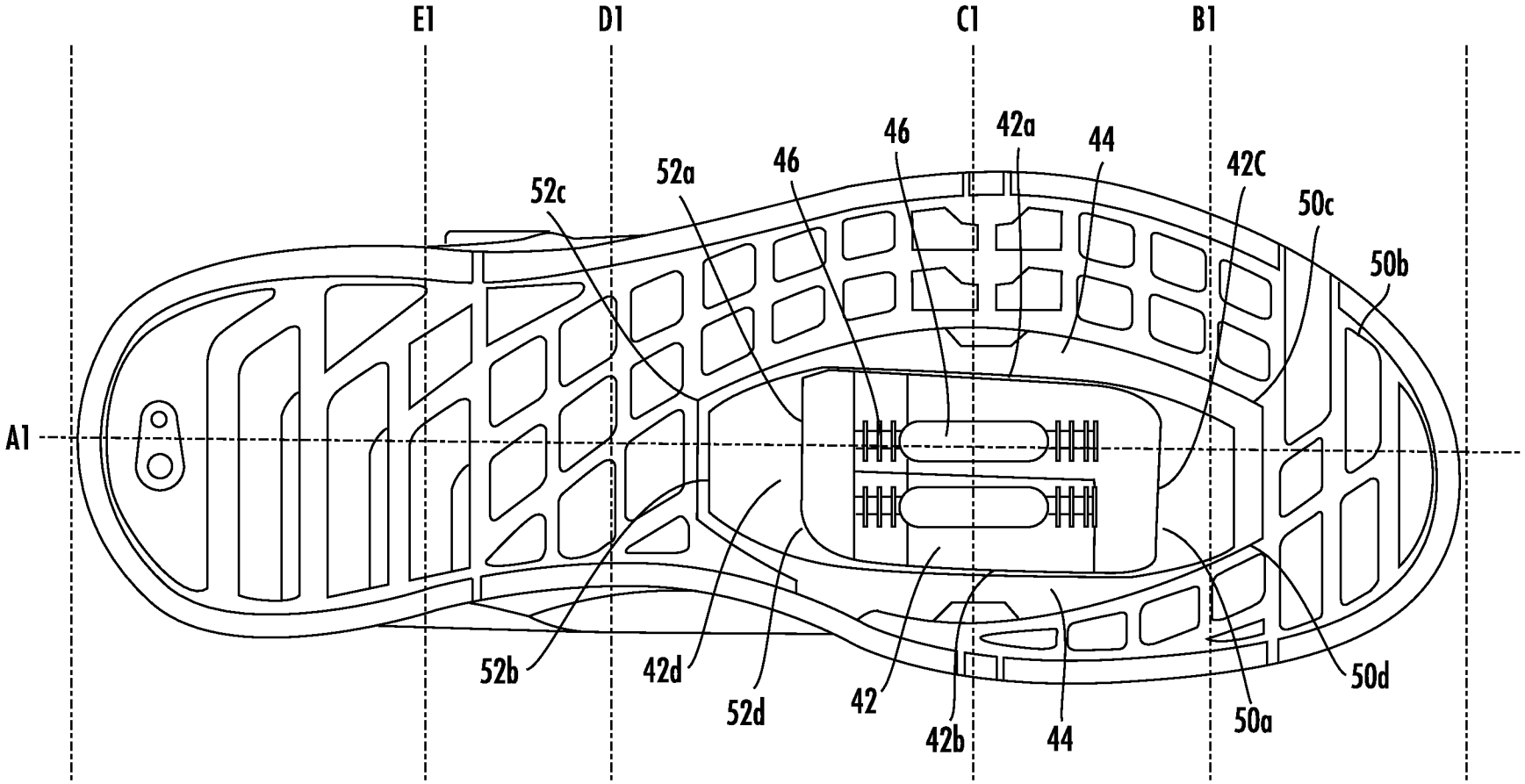
FIG. 3 is a top view of the mountain bike shoe sole according to FIG. 1.

In fact, as clearly visible from FIG. 2, the base faces 36 of the plurality of studs 32 are placed along a substantially regular plane or surface, and define the lower surface of the sole 10, which has a substantially regular, uniform and continuous surface, interrupted by channels 34 and/or by depressions caused by channels 34.

This feature can also be appreciated considering the section FIGS. 10 to 13.

As it can be appreciated from such figures, the outer lateral sides 12 of the sole 10 are walls raising upwardly from the lower surface of the outsole 20 in a substantial perpendicular way with respect to the ground and/or to the outsole 20.

Figure 4:
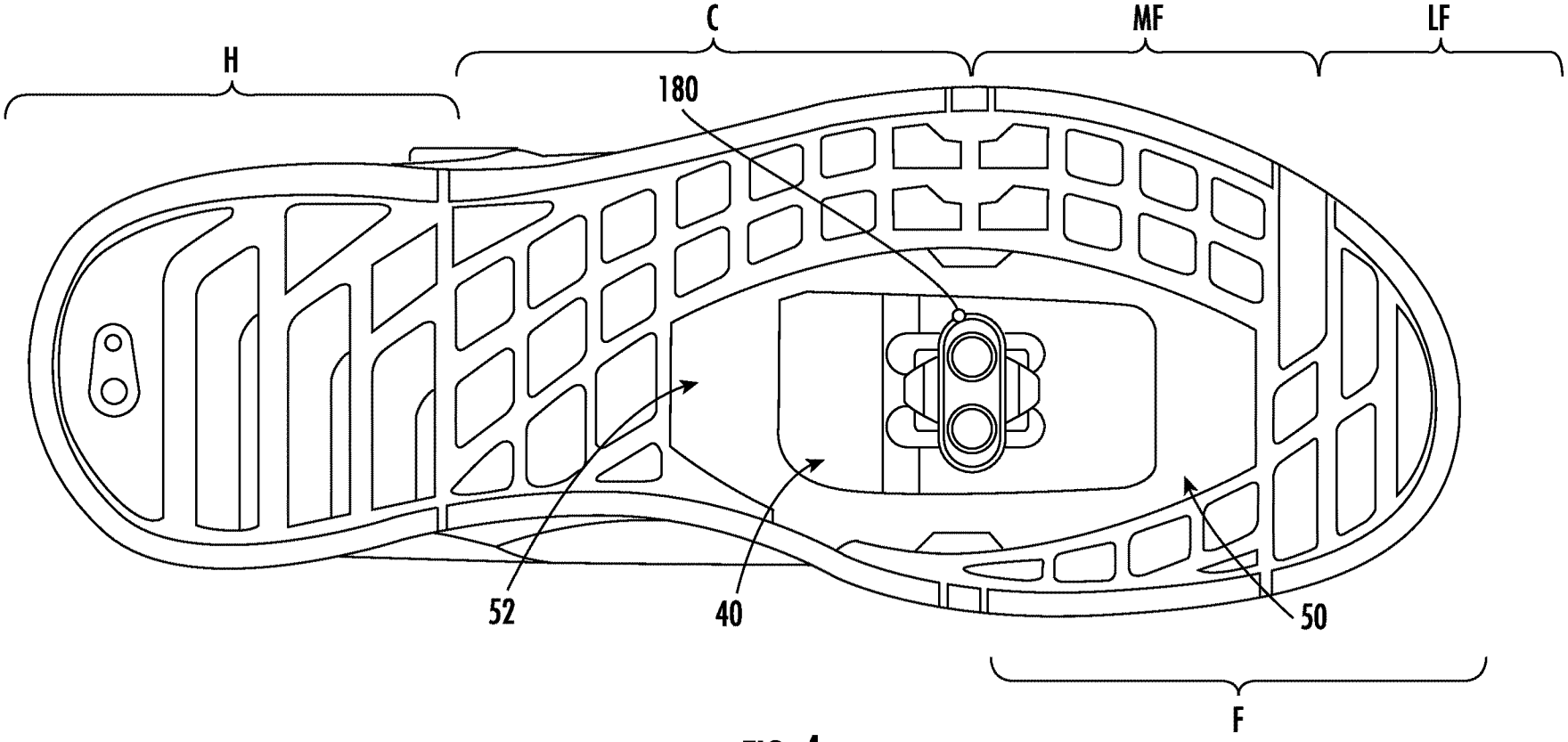
FIG. 4 is a top view of the mountain bike shoe sole of FIG. 1 including a cleat assembly.

As can be visible for example from FIG. 4, in the heel area H of the sole, i.e. the rear portion of the sole at the heel of the foot, all the channels 34 have substantially a cross direction, i.e. they cross the sole from side to side. The same happens in the foremost front area LF of the sole. In these areas H and LF, the studs 32 have substantially an elongated for example rectangular shape, extending from side to side.

In the central area C of the sole 10 (i.e. in the area from the heel area H and the front area F of the sole) and in the medial front area MF of the sole 10 (i.e. the area from the central area C to the foremost front area LF), the channels 34 have some a substantially cross direction and some others a substantially longitudinal direction. The latter have a curved pattern. In particular, longitudinal channels 34 placed in the outer side of the sole 10 have a curved pattern which follows the shape of the outer side of the shoe, and/or they have a curved concave pattern which cavity is faced towards the inner side of the sole. In the inner side of the sole, the longitudinal channels 34 have an opposite curved pattern with respect to the outer one, and/or they have a convex pattern, which cavity if faced towards the outer side of the sole.

In this way, the resulting studs 32 have a square or rhombus shape, which extension is smaller than studs 32 placed at the heel H and foremost front LF areas of the sole 10.

The front portion of the sole 10 is composed by the foremost front LF and medial front MF areas, i.e. from the central area C to the tip of the toes.

Channels 34 have a main size (corresponding to their main development) and a minor size, which crosses the main size.

The minor size of channels 34 is in any way much smaller than sizes of the studs 32. Therefore, the main part of the lower surface of the outsole 20 is defined by the base faces 36 of the studs, and this is the part of the tread 30 and/or of the outsole 20 which rests on the ground.

In at least one version of the invention, the curved pattern of longitudinal channels 34 is designed according to curved "energy lines". This means that, considering that the engagement and the disengagement of the pedal occurs by a rotation movement of the foot (and therefore of the shoe and/or the sole), the curvature of the channels 34 is designed with a specific radius in order to make it easy the pedal operation. The friction among pedal and sole 10 is therefore reduced at a minimum.

In one version of the invention, the curved pattern of longitudinal channels 34 is designed according to the structure and the geometry of a specific pedal, such as Applicant's pedal.

The studs 32 next to such curved longitudinal channels 34 will have the same curvature than the latter.

Remarkably, the sole 10 has a recessed area 40.

The recessed area 40 is provided in the zone of the sole 10 between the central area C and the front area F of the sole 10 (i.e. substantially under the ball of the foot), where a cleat assembly 180 can be secured, as better explained below.

As visible in in FIGS. 1 to 4, the recessed area has a main longitudinal development and its width is smaller than its length.

The recessed area 40 is depressed with respect to the lower surface of the outsole 20.

In details, the recessed area 40 comprises an inner surface 42 and lateral walls 44.

The inner surface of the recessed area is the surface placed at a deeper position with respect to the lower surface of the sole 10. The inner surface 42 has an extension which is on a plane parallel or substantially parallel to the ground. In another version of the invention, the inner surface 42 has a slightly curved planar extension, following the curvature of the sole in that area, and/or is slightly convex with cavity faced towards the upper of the shoe.

The lateral walls 44 in at least one version of the invention are two, respectively placed towards the sides of the foot. They extend from sides 42*a*, 42*b* of the inner surface 42 to the lower surface of the sole 10 itself.

In at least one version of the invention, the lateral walls 44 are substantially perpendicular to the plane of the inner surface 42 and/or to the lower surface of the sole 10.

Sides 42*a*, 42*b* of the inner surface 42 are substantially parallel and they are placed respectively at the outer side and at the inner side of the foot of the user.

They have a size substantially equal to the length of the inner surface 42.

The inner surface 42 also has a front side 42*c* and a rear side 42*d*. Front and rear sides 42*c*, 42*d* are substantially parallel with respect to each other and they are respectively placed at the front and at the rear of the sole 10.

They have a size substantially equal to the width of the inner surface 42. Therefore, the recessed area 40 at the inner surface 42 has, at least in one version of the invention, a constant width.

In any case, the width of the recessed area is smaller than the width of the sole 10.

Therefore, the studs 32 encircle the recessed area 40 of the sole 10. Such studs are in contact with the pedal when engagement occurs.

The lateral walls 44 have a rectangular or trapezoidal shape, and/or an arched shape, if the inner surface 42 has a curved extension.

Each lateral wall 44, at least in a version of the invention, has a specific height 44*a* which is constant. In a version of the invention, such height 44*a* is in a range of 7.5 to 7.9 mm or it is 7.7 mm Such specific size has been proved to make it easier the engagement/disengagement with the pedal. The sole 10, in fact, is suitable to be connected or to house a cleat assembly 180 for a clip-in or clipless pedal at the recessed area 40. When present, at least in one version of the invention, the cleat assembly 180 is a mountain bike cleat system.

Figure 17A:
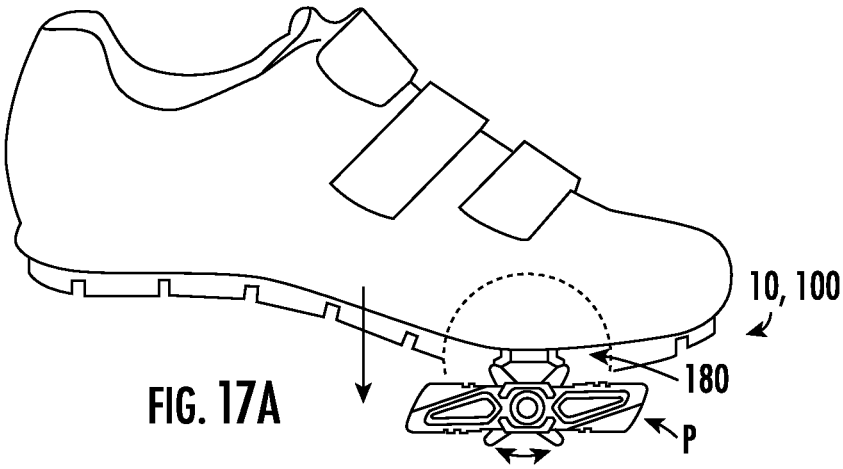
FIGS. 17A, 17B, 17C show three engagement options for the shoe sole of the invention with a clip-in or clipless pedal.
Figure 17B:
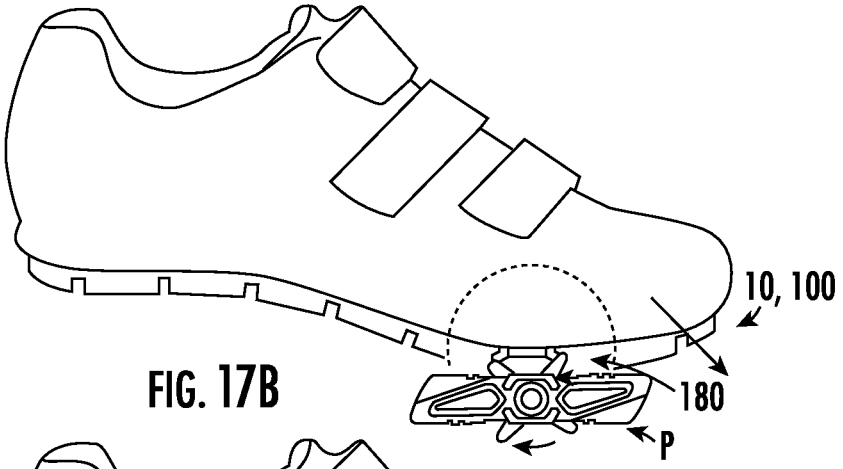
Figure 17C:
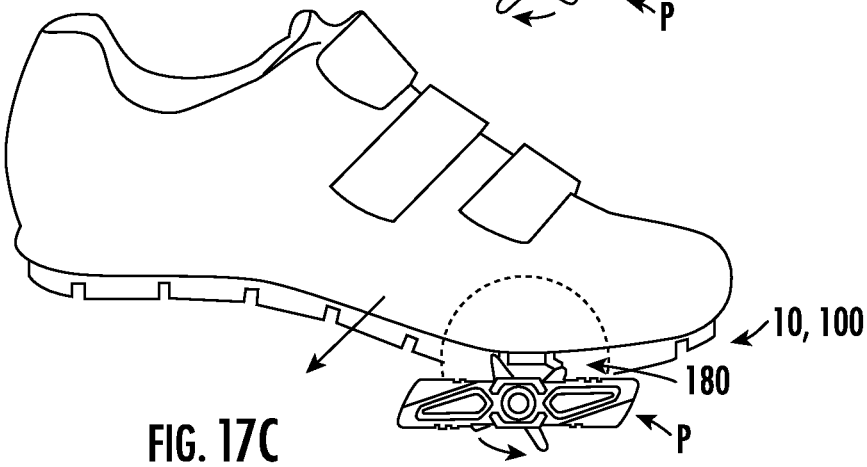

The cleat assembly 180 is suitable to engage an engagement mechanism of the pedal and/or disengage therefrom. FIGS. 17A, 17B, 17C show three engagement options for the shoe sole 10 of the invention with a clip-in or clipless pedal P, i.e. respectively moving the shoe from downwardly, forwardly or rearwardly on the pedal P. In an example, the pedal is a clipless Crankbrothers™ pedal.

The outsole 20 includes, along the recessed area 40, or better along the inner surface 42, two slots 46. The slots 46 have a longitudinal patter and they are parallel with respect to each other.

As it is known, such slots 46 allow the securing the cleat assembly 180 to the outsole 20.

The cleat assembly 180 includes a cleat and fixing members for fixing the cleat to the outsole 20.

The cleat assembly 180 is of known type and therefore it will not be described further.

The sole 10 and/or the recessed area 40 further includes a first ramp 50 (also called an entry ramp) for an easy access of the engagement mechanism of the clipless pedal in the recessed area.

In a preferred version of the invention, the sole 10 and/or the recessed area 40 includes a second ramp 52 (called also an exit ramp), the latter allowing an easy exit of the engagement mechanism of the clipless pedal, when the engagement with the cleat is not needed and/or successful.

The first ramp 50 and/or the second ramp 50 has a sloped surface with respect to the inner surface 42 and/or the lower surface of the sole 10.

In detail, the first ramp 50 is placed at a fore position with respect to the inner surface 42 of the recessed area 40. In particular, the first ramp 50 is placed in the medial front area MF of the sole 10 and ends at the foremost front area LF of the sole 10. More generally, the first ramp 50 is placed in the front area F of the sole 10, at the forefoot of the user.
The first ramp 50 starts at a front side 42*c* of the inner surface 42.

The second ramp 52 is placed at a rear position with respect to the inner surface 42 of the recessed area 40. In particular, the second ramp 52 is placed in the central area C of the sole 10. More generally, the second ramp 52 is placed in the ball or plantar arc area of the foot.

The second ramp 52 starts at a rear side 42*d* of the inner surface 42.

In the version where there are both the first ramp 50 and the second ramp 52, they can have the same shape (but opposite one with respect to the other) or different shapes. In the attached figures, they are both present and have the same shape. It is not however a limit for the scope of protection of the present invention.

In particular, as shown, the first ramp 50 has an inner side 50*a*, corresponding to the front side 42*c* of the inner surface 42, and an outer side 50*b*, placed at the lower surface of the outsole 20. Therefore, the outer side 50*b* is suitable to contact the ground while the inner side 50*a* is recessed with respect to the lower surface of the outsole 20.

The first ramp 50 also has lateral sides 50*c*, 50*d*, in connection with the lateral walls 44 of the recessed area 40. The lateral sides 50*c*, 50*d* are each at a side of the foot. The lateral sides 50*c*, 50*d* are substantially perpendicular to the plane of the ground and/or to the lower surface of the sole 10 and/or to the plane where the first ramp 50 lies and/or to the inner surface 42.

The first ramp 50, therefore, constitutes a sloped or inclined plane or surface which gradually connect the inner surface 42 of the recessed area 40 to the lower surface of the outsole 20.

Furthermore, the outer side 50*b*, in at least one version of the invention, has a size smaller than the size of the inner side 50*a*.

Moreover, the lateral sides 50*c*, 50*d* can have a radial conformation, in order to gradually and uniformly connect with the lateral walls 44 of the recessed portion 40.

In this way, sharped edges and disturbances points are avoided, in order not to disturb the engagement/disengagement with the pedal and in order to avoid the storage of grime or powder or debris collected during use.

Accordingly to what has already been described, the second ramp 52 has an inner side 52*a*, an outer side 52*b*, lateral sides 52*c*, 52*d*, which have the same features disclosed for the first ramp 50, with the difference that the second ramp 52 has a position and conformation which is opposite with respect to the first ramp 50.

In particular, as shown, the second ramp 52 has an inner side 52*a*, corresponding to the rear side 42*d* of the inner surface 42, and an outer side 52*b*, placed at the lower surface of the outsole 20 in a rearwardly position with respect to the recessed area 40. Therefore, the outer side 52*b* is suitable to contact the ground while the inner side 52*a* is recessed with respect to the lower surface of the outsole 20.

The lateral sides 52*c*, 52*d* are in connection with the lateral walls 44 of the recessed area 40. The lateral sides 52*c*, 52*d* are each at a side of the foot.

The second ramp 52, therefore, constitutes a sloped or inclined plane or surface which gradually connect the inner surface 42 of the recessed area 40 to the lower surface of the outsole 20.

Furthermore, the outer side 52*b*, in at least one version of the invention, has a size smaller than the size of the inner side 52*a*.

Moreover, the lateral sides 52*c*, 52*d* can have a radial conformation, in order to gradually and uniformly connect with the lateral walls 44 of the recessed portion 40.

Thanks to the presence of at least one ramp 50, 52, the opening of the recessed portion 40 is greater than the area of the inner surface 42 thereof, allowing an easy access for the engagement mechanism of a clip-in or clipless pedal. At the same way, when the second ramp 52 is present, the greater opening allows an easy exit of the engagement mechanism of the pedal, both when needed or when the engagement is not successful.

Therefore, the at least one ramp 50 "guides" the engagement mechanism of the pedal towards the cleat assembly 180 when the shoe sole is rested on the pedal, in order to make the engagement of the shoe on the pedal. In the same way, the second ramp 52 "guides" the engagement mechanism of the pedal away from the cleat assembly, possibly thanks to a rotational movement of the shoe, when the shoe is to be disassembled from the pedal.

This is particularly useful when the shoes of the user are to be often disengaged, depending on the specific way of riding one is performing.

The inclination of the at least one ramp 50, 52 may vary from less than 180° to 140°. In a version of the invention, first ramp 50 and second ramp 52 have the same size and conformation, with the first ramp 50 inclined inwardly at the rear thereof and the second ramp 52 inclined inwardly at the front part thereof.

In an example of the invention, the length of one ramp 50, 52 is more or less one quarter of the length of the inner surface 42.

The studs 32 placed at the outer side 52*b* of the second ramp 52 are placed in a substantial cross line, in this way, the act as arrest blocks or stoppers when the engagement of the shoe with the pedal is not successful. The sliding of the engagement mechanism of the pedal outside the recessed area 40 is therefore stopped at these points, ensuring a better safe for the user.

Figure 5:
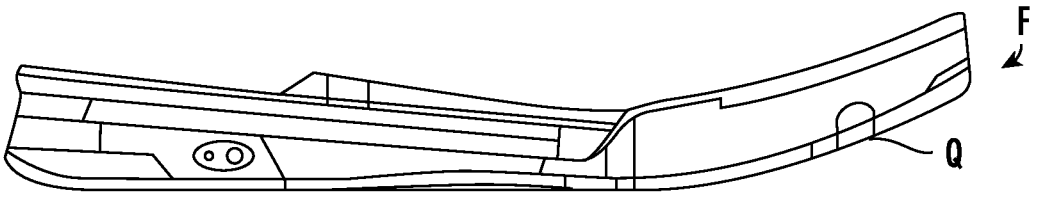
FIG. 5 is a side view of the mountain bike shoe sole of FIG. 1 from the outer side thereof.
Figure 6:
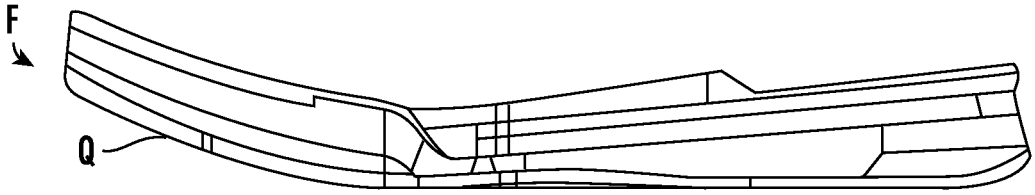
FIG. 6 is a side view of the mountain bike shoe sole of FIG. 1 from the inner side thereof.
Figure 7:
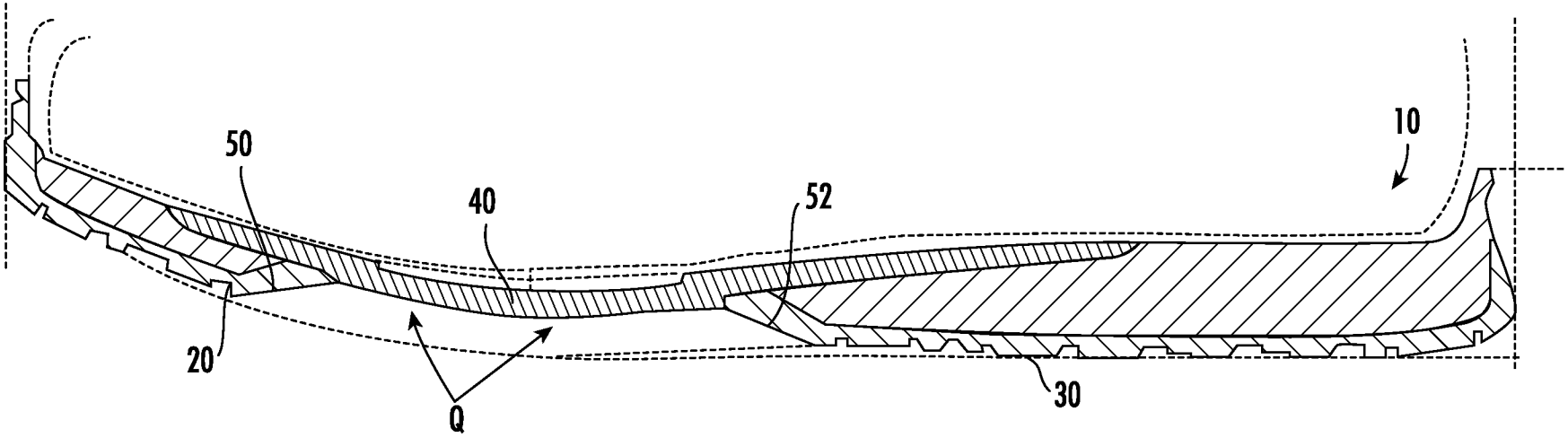
FIG. 7 is a side sectional view taken along the section plane A1 of FIG. 3.
Figure 8:
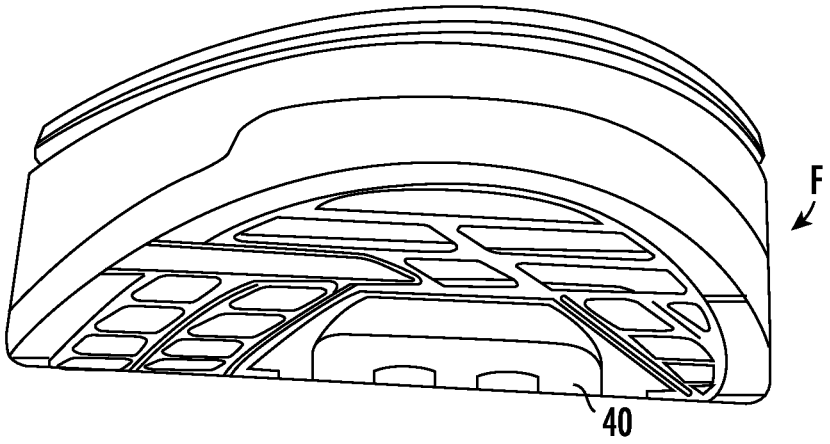
FIG. 8 is a front view of the mountain bike shoe sole of previous figures.
Figure 9:
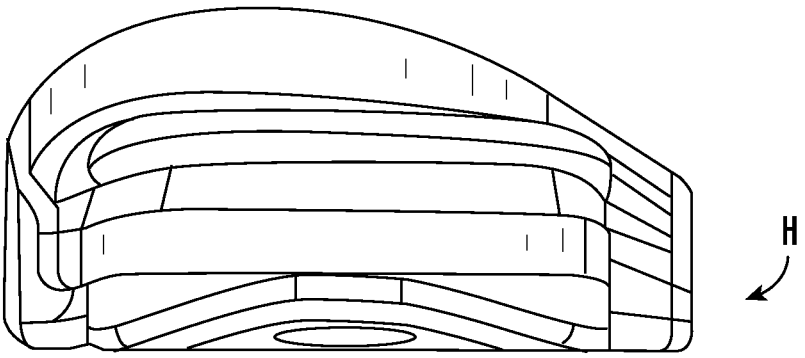
FIG. 9 is a rear view of the mountain bike shoe sole of previous figures.
Figure 10:
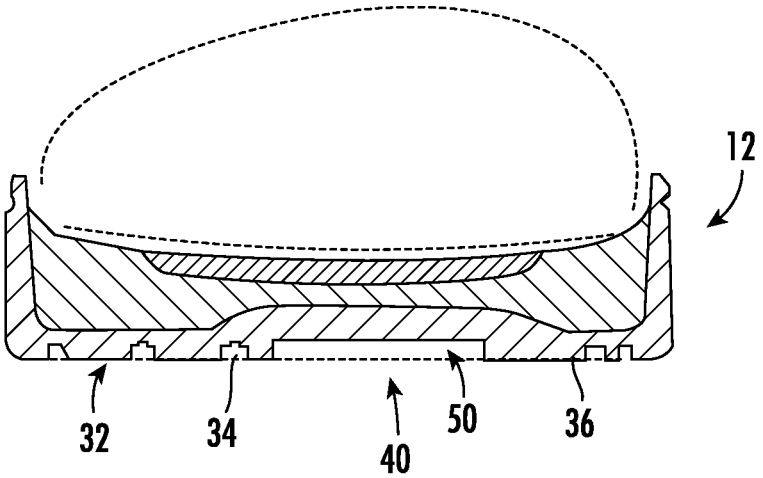
FIGS. 10 and 11 are sectional views taken respectively along the section planes B1 and C1 of FIG. 3.
Figure 11:
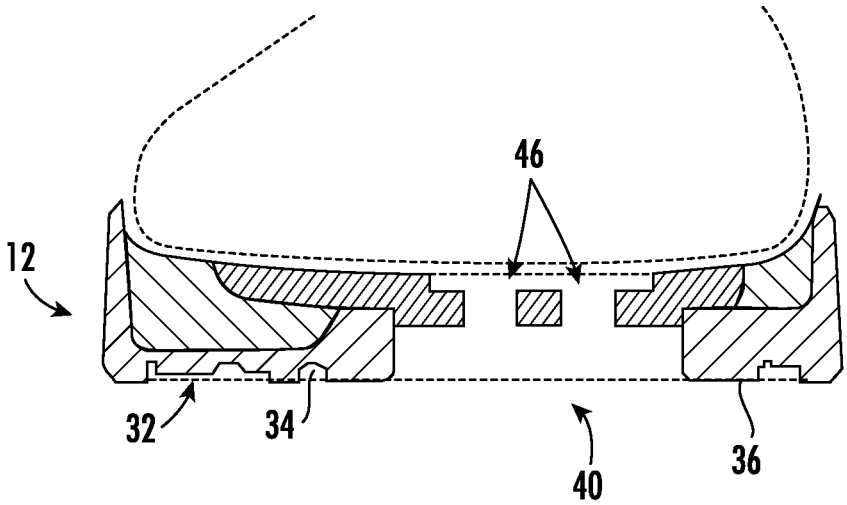
Figure 12:
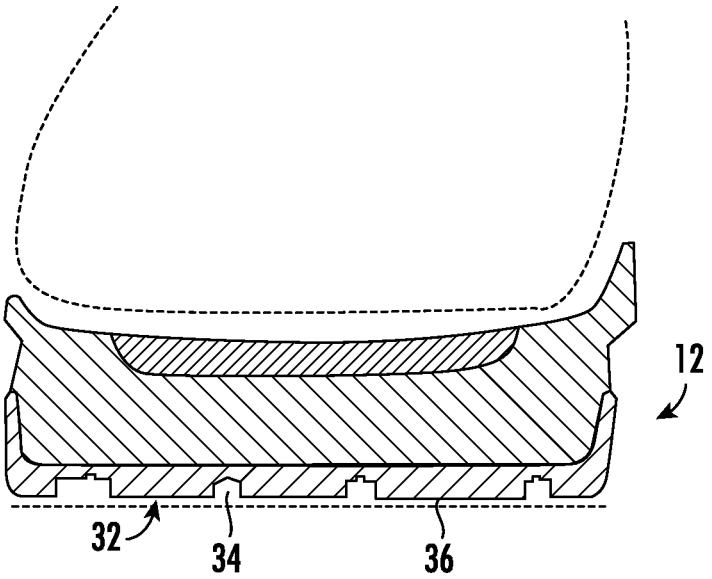
FIGS. 12 and 13 are sectional views taken respectively along the section planes D1 and E1 of FIG. 3.
Figure 13:
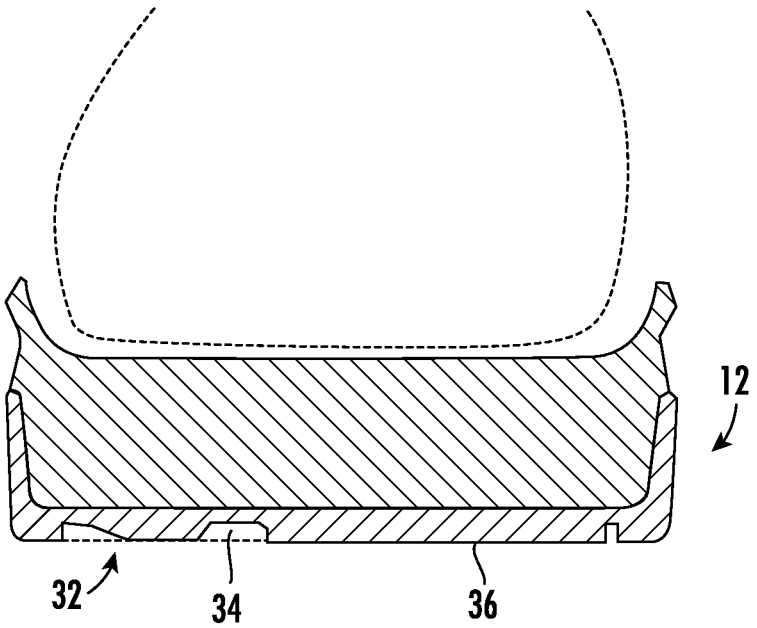

In a version of the invention, as it is visible from FIGS. 5 and 6 for example, the front F area of the sole is raised with respect to the heel H area and/or central area C of the sole 1. In particular the front area F of the sole and/or the recessed area 40 is curved with concavity Q facing away from the ground. In a preferred version of the invention, the radius of such curvature is in the range of 130 mm to 170 mm, especially 150 mm. This measure of curvature makes it easy the engagement with the pedal, considering the foot movement during this action. This is a preferred embodiment of the invention because also a flat sole is possible, but this limits the movement freedom of the foot.

Accordingly to this, the lateral walls 44 are curved of the same extent, together with, in at least one version of the inventions, sides 42*a*, 42*b* of the inner surface 42.

Figure 14:
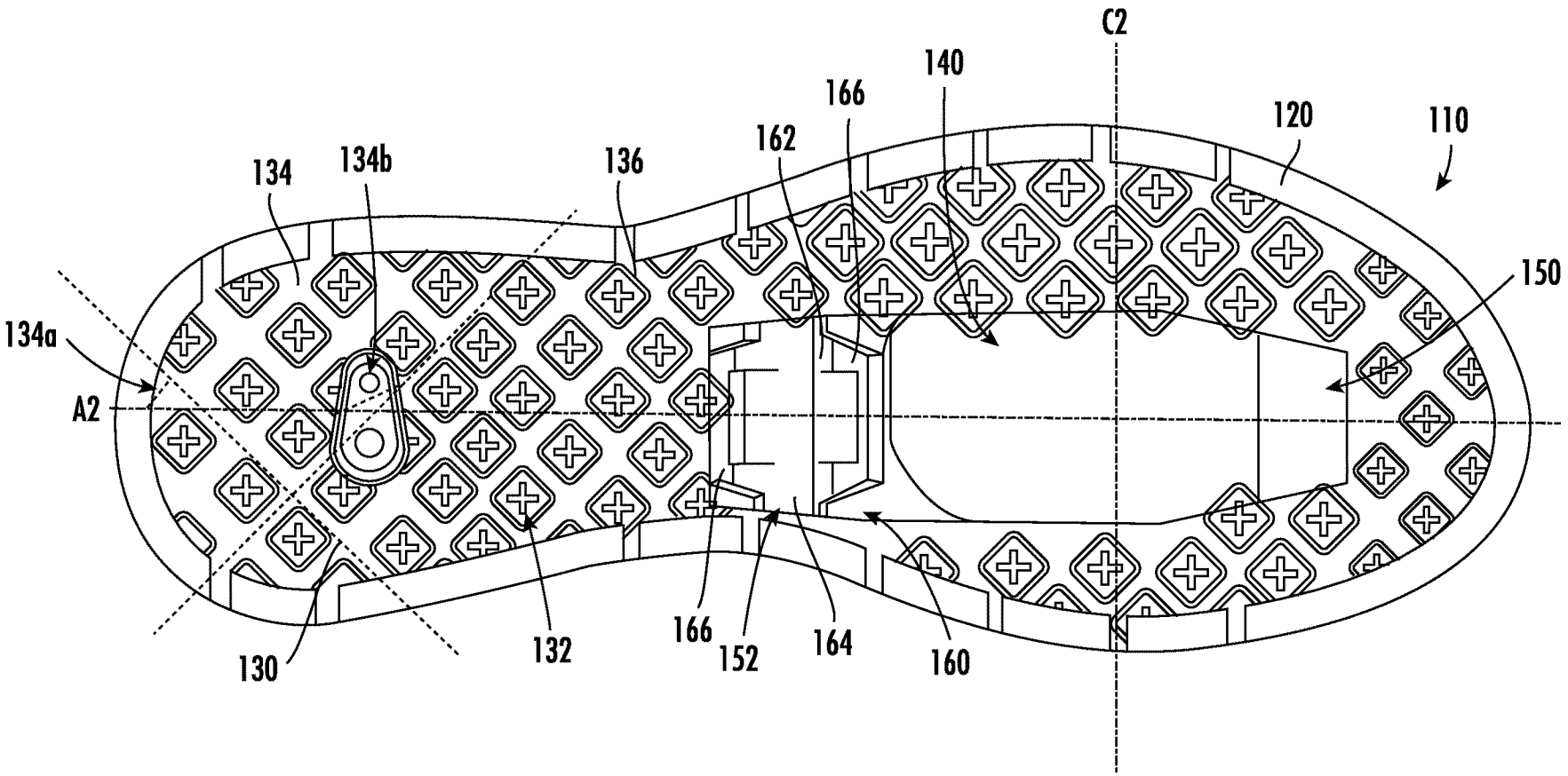
FIG. 14 is a top view of the mountain bike shoe sole according to another embodiment of the invention.

FIG. 14 and following show a further embodiment of the present invention, in particular a mountain bike shoe sole 110. Reference numbers of elements similar to those already disclosed for the previous embodiment will be increased of one hundred. Features already disclosed for each element are to me intended to apply also to elements of the sole 110, when not otherwise indicated.

The sole 110 includes an outsole 120, which defines a lower surface suitable to contact the ground or a bicycle pedal, specifically a clip-in or clipless pedal of a bicycle or mountain bike.

Figure 16:
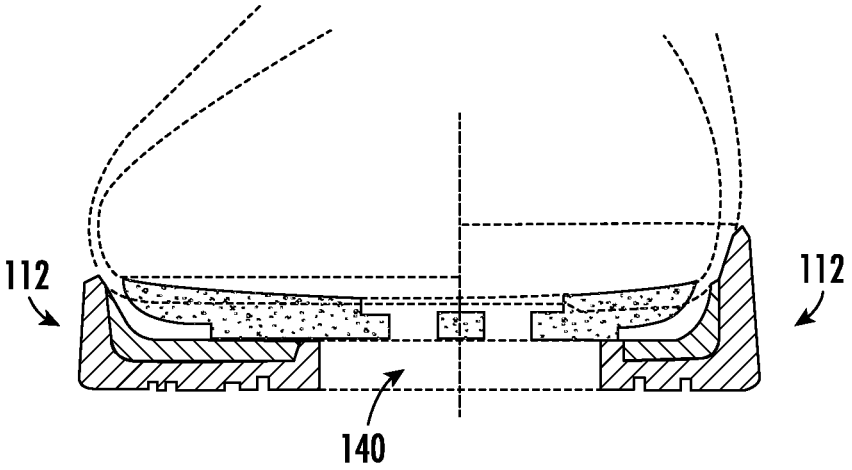
FIG. 16 is a sectional view taken along the section plane C2 of FIG. 14.

As visible in FIG. 16, the outer lateral sides 112 of the sole 110 are walls raising upwardly from the lower surface of the outsole 120 in a substantial perpendicular way with respect to the ground and/or to the outsole 120.

The sole 110 and/or the outsole 120 has or defines a tread 130, which comprises a plurality of studs 132.

Each stud 132 has a sidewall raised inwardly with respect to the lower surface of the sole and a base face 136 which defines the lower surface of the sole 110. The stud 132 and/or the base face 136 can have—in a plan view—a square, rectangular, polygonal or irregular shape. In the showed version, the plurality of studs 132 have almost all the same conformation.

The base face 36, 136 of at least some of the studs 32, 132 can be decorated and/or can have a logo and/or can be stamped, impressed with a determined image or with a plurality of images, different or identical one another.

Each stud 132 is delimited by at least one channel 134, which forms a recessed "line" or zone in the outsole 120.

In at least one version of the inventions, channels 134 have a substantially straight development.

In particular, the channels 134 can form a sort of lattice structure determining a series of cells, each of which forms a stud 132.

In detail, some channels 134 are inclined, considering the section plane A2 of FIG. 14, of an angle 134*a*, some other channels 134 are inclined, considering the section plane A2 of FIG. 14, of an angle 134*b*. In one version of the invention, and/or in at least some portions of the outsole 120, the angle 134*b* measures the able 134*a*+90°.

Remarkably, the sole 110 has a recessed area 140, at least one ramp 150, 152 or a first ramp 150 and a second ramp 152, having the same features already described for the previous embodiment and that are recalled also for this embodiment.

In this specific embodiment, a securement block 160 is provided. The securement block 160 acts as provisional stop area when the engagement of the pedal with the shoe does not occur.

The securement block 160 can be placed at the second ramp 152, occupying the inclined free space determined by the second ramp 152.

The securement block 160 comprises a protrusion 162, for example having a semi-cylindrical or parallelepiped-like conformation or mixture of such conformations. Some detailed views of the securement block 160 are visible in FIGS. 14A and 14B.

Figure 14B:
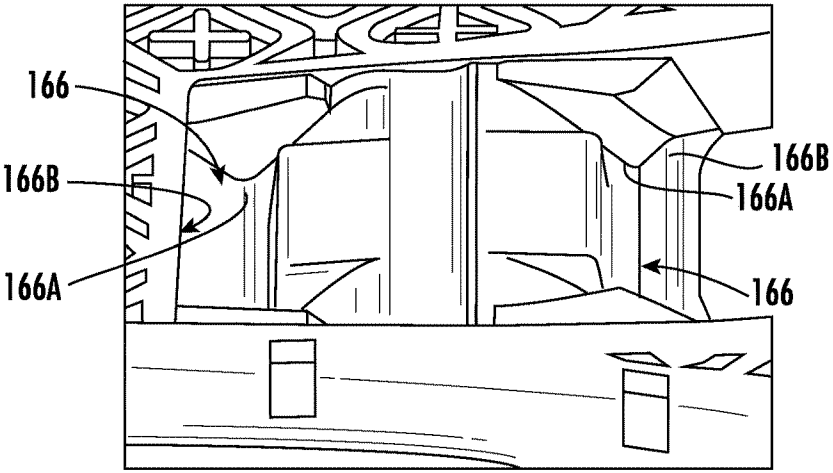
FIGS. 14A and 14B show some detailed views of the securement block of the shoe sole of FIG. 14.
Figure 14A:
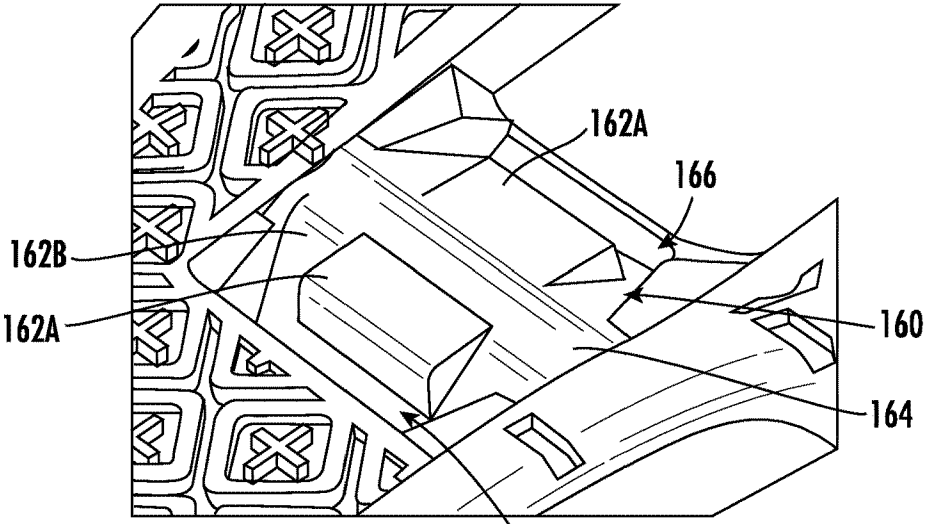

In particular, in the version shown in the FIGS. 14, 14A, 14B, the protrusion 162 comprises a semicylindrical protrusion 162B on top of which a cubic protrusion 162A is placed.

In detail, the semi-cylindrical protrusion 162B comprises a curved lateral wall, two semi-circular bases and a rectangular section base. The rectangular section base is attached to the second ramp 152 and/or to the recessed area 140, the curved lateral wall has a transverse direction as the two semi-circular bases are each placed at a side of the foot.

On the top of the curved lateral wall, the cubic protrusion 162A is placed.

The outermost surface of the protrusion 162 and/or of the cubic protrusion 162A in this specific version, lies on the plane of the lower surface of the sole 110, determining a portion of the outsole 120 and/or of the tread 130.

The outermost surface of the cubic protrusion 162A acts as a stud 132 of the sole 110.

Obviously, the cubic protrusion 162A can also be a cuboid or parallelepiped projection, without departing from the scope of protection of pending claims.

In the same way, the semi-cylindrical protrusion 162B can have similar alternative shapes.

In the illustrated version, at the top of the protrusion 162 and/or of the cubic protrusion 162A, considering the top of the projection as the portion thereof which is suitable to come into contact with the ground, a cross hollow zone 164 is present, shaped for example like a channel.

Furthermore, with respect to the second ramp 152 and/or the recessed area 140, the securement block 160 determines at least one hollow seat 166. In one version of the invention, there are two hollow seats 166, one placed between the securement block 160 and the recessed area 140 and the second placed between the securement block 160 and the lower surface of the sole 110, optionally placed rearwardly with respect to the second ramp 152. The at least one hollow seat 166, together with the securement block 160 are suitable to block the sliding of the engagement mechanism of the pedal, in the event that it is not able to engage with the cleat assembly 180 of the sole 110.

In a specific version of the invention, in fact, the securement block 160 and/or its protrusion 162 and/or the at least one hollow seat 166 have a shape complementary at least in part to the engagement mechanism of the pedal P, in order to help in blocking its sliding.

As far as the hollow seat 166 is concerned, as visible in FIG. 14B, they have a triangular cross section, with one vertex 166A thereof inside with respect to the sole 110. In particular, the vertex 166A is an inner vertex and in at least one version of the invention it has a depth greater than the depth of the recessed portion 140. In other words, the vertex 166A may be more receded inside the sole 110 than the recessed area 140.

In this way, a limit wall 166B is present between the vertex 166A and the recessed area 140 which determines an obstacle for pedal P sliding, when the engagement with the sole 110 is not needed/successful.

The limit wall 166B can have a perpendicular extension, with respect to the lower surface of the sole 110 of can have an inclination opposed with respect to the portion of the adjacent curved lateral wall of the semi-cylindrical protrusion 162B. in particular, the limit wall 166B placed towards the front F of the sole 110 is inclined rearwardly towards the inside of the sole 110, while the limit wall 166B placed towards the heel area H of the sole 110 is inclined forwardly towards the inside of the sole 110.

In a version of this embodiment, the second ramp 152 may not be present, and in the place of the latter the securement block 160 is located.

Figure 15:
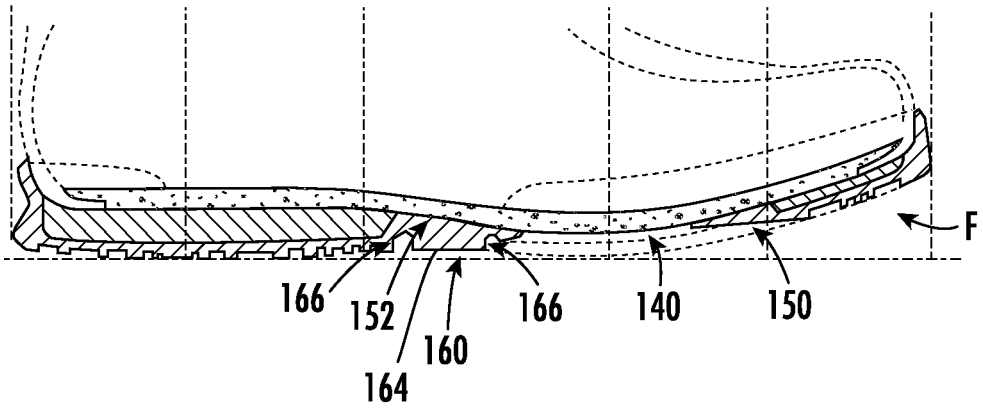
FIG. 15 is a side sectional view taken along the section plane A2 of FIG. 14.

In a version of the invention, as it is visible from FIG. 15, the front F area of the sole 110 is raised with respect to the heel H area and/or central area C thereof. In particular the front area F of the sole 110 and/or the recessed area 140 is curved with concavity Q facing away from the ground. In a preferred version of the invention, the radius of such curvature is in the range of 130 mm to 170 mm, especially 150 mm.

In some examples of the present invention, we can find the following sizes or measures.

The recessed portion 140, in at least one version of the invention, has a width in the range of 40 mm to 45 mm or of 42 mm and a length in the range between 50 mm and 55 mm or of 53 mm.

The channels 34 can have a height of 2 mm or 2.2 mm.

The outer lateral side 12 of the sole 110 can have a height of 30 mm in the rearmost portion of the heel area. The tip of the foremost portion of the outer lateral side 12 of the sole 110 can be raised from the ground of 45 to 55 mm or of 47 mm and the lower surface, in such point, is raised from the ground of 25 mm to 30 mm or of 26 mm.

The outer lateral side 12 of the sole 10 can have a height of 36-37 mm in the rearmost portion of the heel area. The tip of the foremost portion of the outer lateral side 12 of the sole 10 can be raised from the ground of 45 mm to 55 mm or of 52.5 mm.

The recessed portion 40, in at least one version of the invention, has a width in the range of 40 mm to 45 mm or of 40 mm and a length in the range between 70 mm and 80 mm or of 75 mm.

The outer side 50*b* of the first ramp 50 and/or the outer side 52*b* of the second ramp 52 is in the range of 15 mm to 40 mm or of 25 mm to 30 mm or of 26 mm (same measures can apply also for the first ramp 150 and the second ramp 152).

The length (i.e. for example the distance between the outer side and the inner side) of the first ramp 50, 150 and/or of the second ramp 52, 152 may vary from 10 mm to 30 mm. In the embodiments of the inventions previously disclosed individual features, given in connection with such specific embodiments, may actually be interchanged with other different features that exist in other embodiments.

The present invention has been described according to preferred embodiments, but equivalent variants can be devised without departing from the scope of protection offered by the following claims.

The invention claimed is:

1. A mountain bike shoe sole, comprising an outsole having a lower surface and a tread, at least a recessed area, provided in said lower surface of said outsole and recessed with respect thereof, for housing a cleat assembly and comprising an inner surface and lateral walls, wherein said sole further comprises at least one ramp which has a sloped surface with respect of said inner surface and/or lower surface of said outsole, wherein said at least one ramp includes a first ramp placed at a fore position with respect to said inner surface for an easy access of an engagement mechanism of a clipless pedal in said recessed area and a second ramp placed at a rear position with respect to said inner surface for an easy exit of an engagement mechanism of a clipless pedal, wherein said first ramp has lateral sides in connection with the lateral walls of said recessed area, wherein said lateral sides are perpendicular to said lower surface of the sole.

2. The mountain bike shoe sole according to claim 1, wherein said first ramp starts at a front side of said inner surface while said second ramp starts at a rear side of said inner surface.

3. The mountain bike shoe sole according to claim 2, wherein said first ramp further comprises an inner side, corresponding to the front side of the inner surface, and an outer side, placed at the lower surface of the outsole.

4. The mountain bike shoe sole according to claim 3, wherein said outer side has a size smaller than the size of the inner side and/or wherein said the lateral sides have a radial conformation, in order to gradually and uniformly connect with lateral walls of said recessed portion.

5. The mountain bike shoe sole according to claim 1, wherein said second ramp has an inner side, corresponding to a rear side of said inner surface, an outer side, placed at the lower surface of the outsole in a rearwardly position with respect to the recessed area, and lateral sides, in connection with lateral walls of the recessed area.

6. The mountain bike shoe sole according to claim 1, wherein said outsole includes, along said recessed area and/or along said inner surface, two slots for connection during use with said cleat assembly.

7. The mountain bike shoe sole according to claim 1, wherein said tread comprises a plurality of studs and at least one channel.

8. The mountain bike shoe sole according to claim 7, wherein each stud of said plurality of studs is determined by said at least one channel, wherein each stud of said plurality of studs has a sidewall raised inwardly with respect to the lower surface of the sole and a base face which defines the lower surface of the sole can have, in a plan view, a square, rectangular, polygonal or irregular shape.

9. The mountain bike shoe sole according to claim 8, wherein said base face has a square, rectangular, polygonal or irregular shape.

10. The mountain bike shoe sole according to claim 7, wherein said at least one channel comprises channels having a substantially cross direction and channels having a substantially longitudinal direction, wherein said channels having a substantially longitudinal direction have a curved pattern which follows the shape of the outer side of the sole.

11. The mountain bike shoe sole according to claim 10, wherein said channels having a substantially longitudinal direction, placed at the lateral outer side of the sole have a curved concave pattern which cavity is faced towards the inner side of the sole while said channels having a substantially longitudinal direction, placed at the lateral inner side of the sole, have a curved convex pattern which cavity if faced towards the outer side of the sole.

12. The mountain bike shoe sole according to claim 1, wherein said recessed area is provided in a zone of the sole between a central area (C) and a front area (F) of the sole and has a width which is constant and/or which size is smaller than the size of a main longitudinal length thereof.

13. The mountain bike shoe sole according to claim 1, wherein said recessed area comprises said inner surface and lateral walls, wherein said inner surface is the surface of said receded area placed at a deeper position with respect to the lower surface of the sole and/or wherein said inner surface has a flat extension or a slightly curved planar extension, with cavity faced away from said lower surface of the outsole.

14. The mountain bike shoe sole according to claim 13, wherein said lateral walls are placed respectively towards the sides of the foot and/or said lateral walls are substantially perpendicular to the plane of the inner surface and/or to the lower surface of the outsole and/or wherein said lateral walls have a rectangular or trapezoidal shape, and/or an arched shape if the inner surface has a curved extension, and/or wherein each of said lateral walls has a height sized in a range of 7.5 to 7.9 mm or of 7.7 mm.

15. The mountain bike shoe sole according to claim 1, wherein said inner surface comprises sides which are substantially parallel and are placed respectively at the outer side and at the inner side of the foot of the user and/or wherein said sides have a size substantially equal to the length of the inner surface.

16. The mountain bike shoe sole according to claim 1, wherein said inner surface comprises a front side and a rear side, which are substantially parallel with respect to each and have a size substantially equal to the width of the inner surface.

17. The mountain bike shoe sole according to claim 1, wherein said sole is, in a front (F) part thereof, raised with respect to a heel (H) area and/or central area (C) of said sole and/or wherein said sole is, in a front (F) part thereof and/or said recessed area is curved with concavity (Q) facing away from the ground.

18. The mountain bike shoe sole according to claim 17, wherein said concavity (Q) has a curvature radius in the range of 130 mm to 170 mm.

19. The mountain bike shoe sole according to claim 1, comprising a securement block or a provisionally stop area when the engagement of a pedal with the sole does not occur.

20. The mountain bike shoe sole according to claim 19, wherein said securement block comprises a protrusion with a semi-cylindrical and/or parallelepiped-like conformation or mixture of such conformations and/or wherein an outermost surface of said protrusion lies on the plane of the lower surface of the outsole, determining a portion of said outsole and/or of said tread, and/or wherein said securement block further comprises a cross hollow zone, shaped like a channel and/or wherein said securement block determines at least one hollow seat or two hollow seats, one placed between the securement block and the recessed area and another placed between the securement block and the lower surface of the sole.

* * * * *